United States Patent [19]

Frawley et al.

[11] Patent Number: 4,781,535

[45] Date of Patent: Nov. 1, 1988

[54] APPARATUS AND METHOD FOR SENSING DIAPHRAGM FAILURES IN RECIPROCATING PUMPS

[75] Inventors: James J. Frawley, Honeoye Falls; Richard L. Mearns, Pittsford, both of N.Y.

[73] Assignee: Pulsafeeder, Inc., Rochester, N.Y.

[21] Appl. No.: 119,934

[22] Filed: Nov. 13, 1987

[51] Int. Cl.[4] ..... F04B 21/00; F04B 43/06; G08B 21/00

[52] U.S. Cl. ..... 417/53; 417/63; 417/383; 417/9; 92/5 R; 92/103 SD; 340/605

[58] Field of Search ..... 417/53, 63, 9, 383, 417/395; 92/5 R, 103 F, 103 M, 103 SD; 340/605, 679; 73/40

[56] References Cited

U.S. PATENT DOCUMENTS

| | | | |
|---|---|---|---|
| 2,239,270 | 4/1941 | Jahreis | 417/9 |
| 2,323,950 | 7/1943 | Wade | 417/63 |
| 3,131,638 | 5/1964 | Wilson et al. | 92/5 R X |
| 3,431,823 | 3/1969 | Orlita | 92/5 R X |
| 3,807,906 | 4/1974 | Breit | 417/63 X |
| 4,342,988 | 8/1982 | Thompson et al. | 340/679 |
| 4,529,974 | 7/1985 | Tanaka et al. | 340/605 |
| 4,569,634 | 2/1986 | Mantell | 417/63 |

FOREIGN PATENT DOCUMENTS

| | | | |
|---|---|---|---|
| 1453454 | 2/1969 | Fed. Rep. of Germany | 417/395 |
| 3334638 | 3/1984 | Fed. Rep. of Germany | 417/63 |
| 3532702 | 3/1987 | Fed. Rep. of Germany | 340/605 |
| 195087 | 11/1983 | Japan | 417/63 |

*Primary Examiner*—Paul F. Neils

*Attorney, Agent, or Firm*—Pollock, Vande Sande & Priddy

[57] ABSTRACT

Apparatus for monitoring the diaphragm integrity in a diaphragm pump. A single continuous circuit trace is supported on a pump diaphragm. An electrical circuit is connected to the continuous circuit trace for measuring both the continuity and a potential ground fault condition between the circuit trace and pumping liquid. The circuit trace is formed in a configuration which resists the effects of strain induced by continuous flexing of the diaphragm.

15 Claims, 5 Drawing Sheets

FIG 1
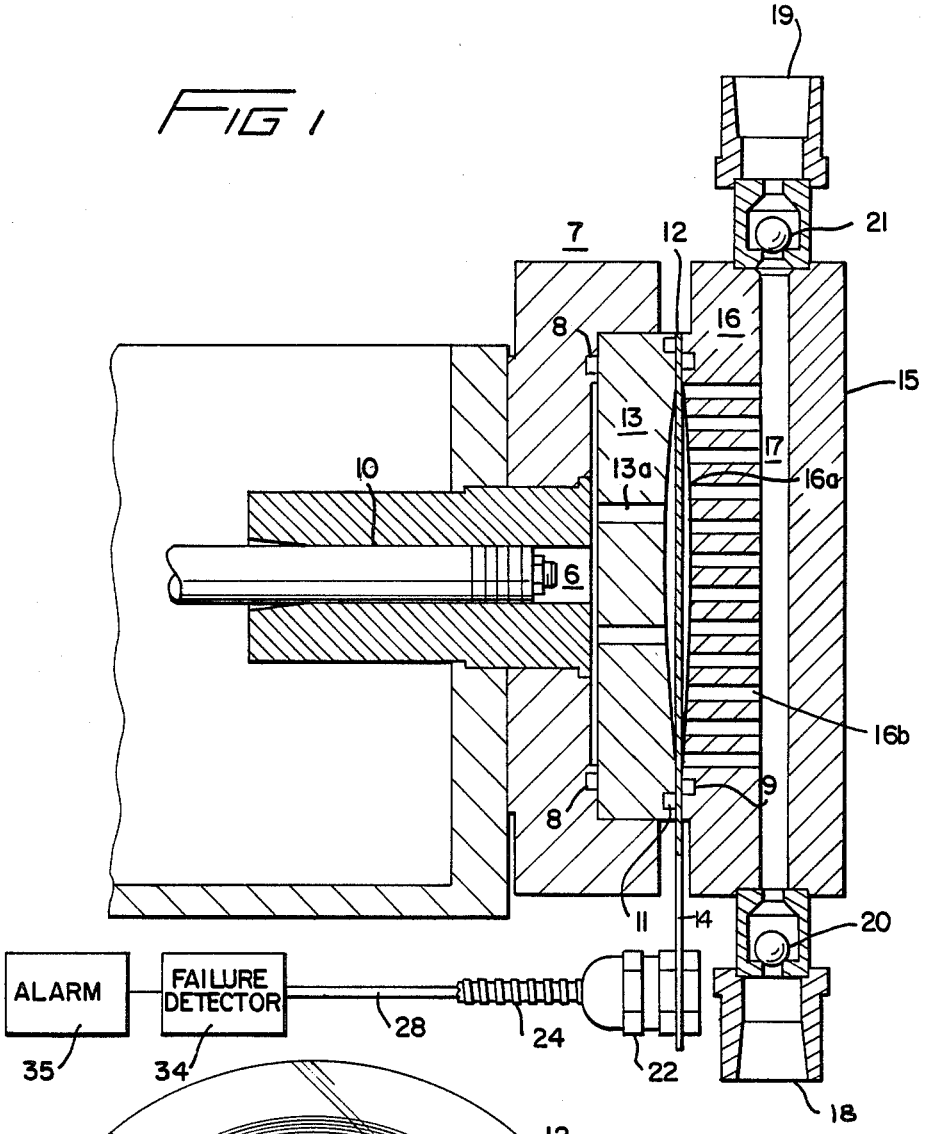
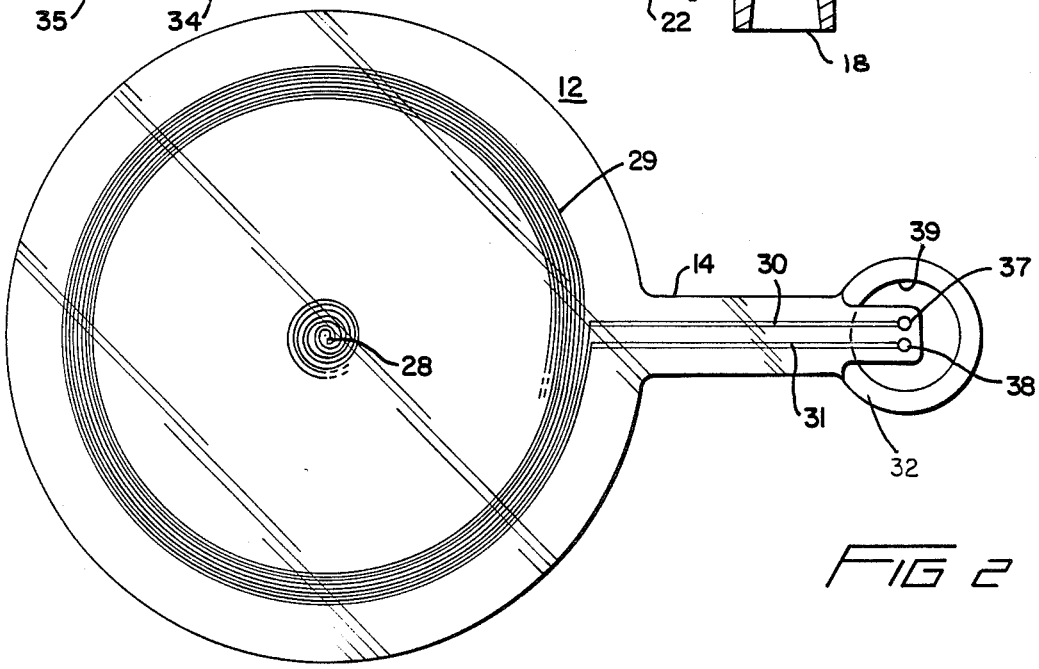
FIG 2

APPARATUS AND METHOD FOR SENSING DIAPHRAGM FAILURES IN RECIPROCATING PUMPS

The present invention relates to fluidic devices which employ diaphragms. Specifically, apparatus for monitoring the integrity of a diaphragm in a diaphragm pump is disclosed.

The diaphragm pump utilizes a piston acting upon a volume of liquid bounded on one side by a flexible diaphragm. The other side of the diaphragm forms a boundary with pumped liquid to a pumping chamber. Reciprocating motion of the piston causes alternating flexure of the diaphragm, transmitting a change in volume to the liquid in the pumping chamber. As the piston retracts, pumping chamber volume increases, reducing pressure, so that the discharge check valve remains closed while a volume of liquid equal to piston displacement is admitted through the inlet check valve. As the piston advances, pressure is increased, causing the inlet check valve to close and expel an equal volume of liquid through the discharge check valve.

A major advantage of the diaphragm pump is the transmission of hydraulic power through a flexible membrane, or diaphragm, without the reciprocating or rotating liquid seals required for most pumping devices. Consequently, it is essentially leak-free under normal operating conditions, making it a preferred device for the transfer or metering of chemically or biologically hazardous liquids. It is likewise a preferred device for handling liquids of a required level of purity which might be contaminated by inward leakage from exterior sources.

Various methods for detecting diaphragm rupture have been employed in the past. These include the use of two diaphragm halves which have a vacuum drawn between them. The rupture of one or the other diaphragm half results in the loss of vacuum which may be detected by monitoring the pressure of the space between halves.

In another technique, two diaphragms are employed, separated by an intermediate liquid. A pair of electrodes are immersed in the intermediate liquid. A change in electrical resistance between the two electrodes may be used to sense the presence of the pumped liquid indicating the rupture of one of the diaphragms. The presence of a hydraulic liquid may also be detected when the other of the diaphragms ruptures which also results in a corresponding change in resistance between the electrodes.

Recently, techniques have been proposed to sense diaphragm rupture by sensing the change in electrical resistance between an insulated conductor supported on the diaphragm and the pumped liquid. This ground fault measuring technique is described in U.S. Pat. No. 4,569,634.

Another technique which has heretofore been limited to rupture disc assemblies is disclosed in U.S. Pat. No. 4,342,988. This patent describes the use of a conductive loop which is monitored to determine the integrity of a deformable member supporting the loop. Any change in the conductive loop is sensed as a change in the deformable member integrity.

The present invention, while incorporating some teaching of each of the mentioned patents, provides a distinctly different apparatus which will provide an improved failure detection probability over either of the devices described in these patents. The disclosed apparatus will have a useful life coextensive with the diaphragm life.

SUMMARY OF THE INVENTION

It is an object of this invention to rapidly detect the failure of a diaphragm in a diaphragm pump.

It is a more specific object of this invention to provide for the sensing of diaphragm integrity in multiple modes, any one of which will provide a failure indication.

It is yet another object of this invention to provide a sensing conductor on a diaphragm which has a useful life coextensive with the diaphragm's useful life.

These and other objects of the invention are accomplished in accordance with a diaphragm structure which contains a continuous conductive circuit trace covering substantially the entire surface area of the diaphragm and insulated from an adjacent liquid. The continuous circuit trace preferably extends from the outer periphery of the diaphragm towards the center of the diaphragm. Both the continuity of the continuous circuit trace and the ground fault current which flows from the circuit trace through the pumped liquid are monitored to detect a fault.

In a preferred embodiment of the invention, the conductive circuit trace is formed as a printed circuit trace. The substrate bearing the trace is bonded to the diaphragm surface. The trace is formed as a plurality of radial spokes. The radial spokes include circumferential segments interconnected to form a single conductive circuit trace which changes direction a plurality of times as it traverses the distance from the periphery to the center of the diaphragm. This configuration reduces the level of strain applied to the circuit to a level significantly lower than that applied to the diaphragm material itself. The behavior of the circuit is analogous to that of a spring, which, because of its geometrical configuration, can withstand large deformations and long-term flexure without failure. The circuit trace continuity is maintained for the life of the diaphragm or greater, and is lost only in response to diaphragm failure.

DESCRIPTION OF THE FIGURES

FIG. 1 illustrates a typical diaphragm pump structure incorporating the apparatus of the invention.

FIG. 2 illustrates the one embodiment of a diaphragm sensing circuit trace for detecting a diaphragm failure.

DESCRIPTION OF THE PREFERRED EMBODIMENT

Figure 3:
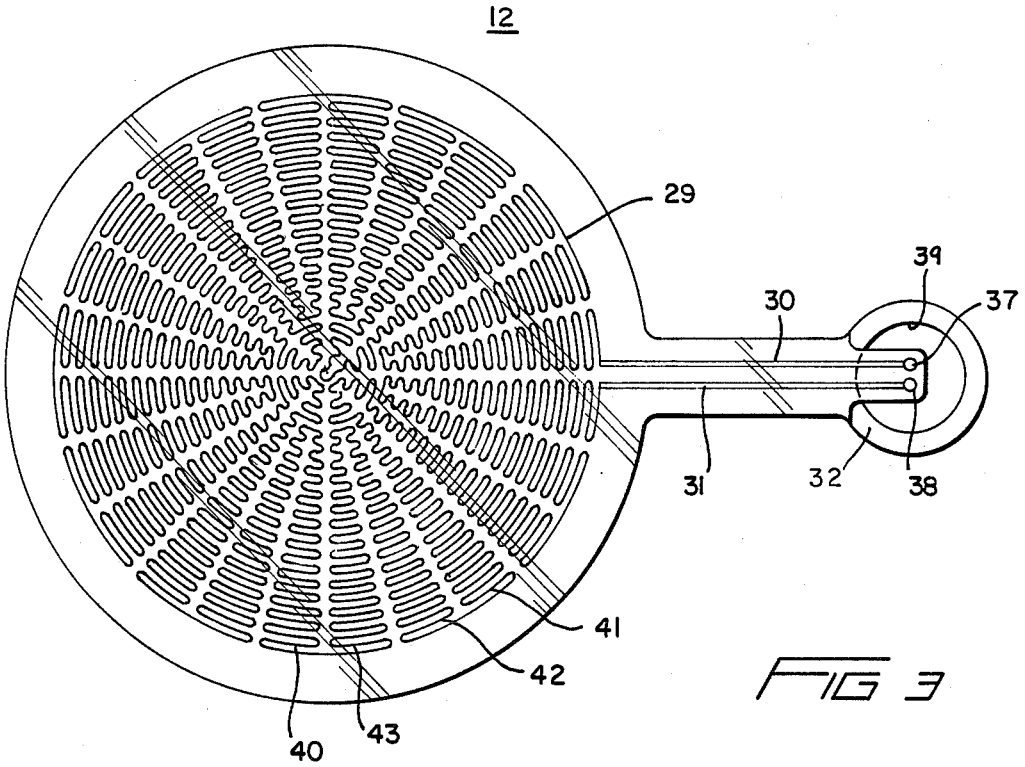
FIG. 3 illustrates a preferred embodiment of a diaphragm sensing circuit trace which is resistant to strain and fatigue.

Referring now to FIG. 1, there is shown a conventional diaphragm pump which employs a diaphragm equipped with a failure detection apparatus in accordance with the present invention. Those familiar with diaphragm pumps will recognize the reagent head assembly 15 which includes a pumping chamber 17 connected at both ends to an inlet 18 and outlet 19. The inlet 18 and outlet 19 include respective ball valves 20 and 21 for providing one-way liquid flow through the pumping chamber 17.

Pump head assembly 7 includes a cylinder bore 6. The diaphragm 12 is clamped between the peripheral portions of the reagent head 16 and the dishplate 13. A pair of O-ring seals 9, 11 are between the diaphragm 12 and the reagent head 16 and the dishplate 13, respectively.

Facing the curved dish surface 16*a* is a diaphragm 12, shown to be metal which may be grade 316 stainless steel in the pump arrangement of FIG. 1. The metal diaphragm incorporates a continuous circuit trace insulated from the diaphragm and disposed on the diaphragm side which is normally not in contact with the pumped liquid.

The diaphragm pump of FIG. 1 includes, on the remaining side of diaphragm 12, another O-ring seal 11, which seals the diaphragm with a curved dish plate 13. Dish plate 13 is a removable part of the pump head assembly 7. Additional O-ring 8 seals the removable dish plate 13 with the pump head assembly.

A reciprocating piston 10 is shown which will force a hydraulic liquid medium through the openings 13*a* of the dish plate, thereby flexing the diaphragm 12 in a direction to pressurize the pumping chamber 17. The curved surface of dish plate 13 is substantially concave. Surface 16*a* of the dish of the reagent head assembly is similarly curved. Surface 16*a* and dishplate 13 protect the diaphragm from excessive displacement which would tear or rupture the diaphragm.

The operation of the pump can be briefly described beginning with the reciprocating piston 10, which is driven linearly in the chamber 6. The piston forces a hydraulic liquid through channels 13*a* against the diaphragm 12. Flexure of diaphragm 12 will transmit a change in volume to the liquid in the pumping chamber 17 via channels 16*b*, forcing liquid through outlet valve 21 while closing valve 20. As the piston 10 retracts, pumping chamber 17 volume increases, reducing pressure, so that outlet valve 21 closes, permitting a volume of liquid 20 equal to the piston 11 displacement to enter the pumping chamber 17.

A conduit connector 22 protects a pair of conductors 28 which are connected to a continuous circuit trace supported on the diaphragm 12. Conductors 28 exit through the conduit connector 22, and via an armored cable 24, are connected to failure detector circuit 34. When a tear or rupture in the diaphragm 12 occurs, the failure detector will provide an enable signal to an alarm 35. Alarm 35 may be an audible or visual alarm indication that a failure in diaphragm 12 has occurred or is imminent. Additionally, the enable signal may be used to stop pump operation.

The metal diaphragm 12 shown in FIG. 1 can be configured in accordance with FIGS. 2 and 3. In both FIGS. 2 and 3, a single continuous circuit trace 29 is supported on the diaphragm 12 insulated therefrom, facing the hydraulic liquid, and which includes insulating layers 45 and 48, as shown more particularly in the section view of FIG. 4. The single circuit trace 29 is shown in FIG. 2 as a double spiral. The center of the double spiral coincides with the center of the diaphragm 12. The two ends of each spiral are joined together at the center. The double circuit trace is then wound in a spiral until substantially all of the surface area of the diaphragm is covered by the circuit trace. The spacing of the circuit trace 29, which is desired to be small in order to enhance detection resolution, has been selected to be approximately 0.015 inches (15 mils) as determined by the present economics and state of the art of the flexible printed circuit manufacturing processes.

An extending tab 14 for the diaphragm provides support for the exit leads 30 and 31 of the spiral circuit trace 29, and supports a connector 22 in hole 39. The insulating substrate supporting the spiral 29 necks down at 32 so that eyelets 37 and 38 are supported over the hole 39. Eyelets 37 and 38, connected to exit leads 30 and 31 receive the conductors 28 of FIG. 1 and are soldered thereto or otherwise electrically bonded to eyelets 37 and 38.

An improved version of the diaphragm with a continuous sensing circuit trace is shown in FIG. 3. It has been found that, although the diaphragm of FIG. 2 will work under many conditions, the diaphragm of FIG. 3 provides a circuit trace 29 which experiences lower levels of strain during operation of the diaphragm. The circuit trace 29 is a single continuous circuit trace formed as a plurality of 24 radial segments or spokes which decrease in size towards the center of the diaphragm. Each radial segment is comprised of a plurality of circumferential segments 40, decreasing in size, the ends of each circumferential segment connected to an adjacent circumferential segment. The radial segments are interconnected at both ends to provide a continuous circuit trace alternating in direction as it extends from the periphery to the center of the diaphragm 12. The three identified radial segments 41, 42 and 43 commence with their outer circumferential segments connected to an adjacent radial segment. The individual circumferential segments shown generally as 40 decrease in length to define a taper for each radial segment. The ends of each radial segment are connected to an adjacent radial segment in a manner which will provide a continuous single circuit trace covering substantially the entire surface area of the diaphragm 12.

Variations of the embodiment of FIG. 3 may be perfected without departing from the principle of having multiple circumferential segments disposed on the diaphragm 12 and connected such that the single circuit trace formed from the segments changes direction frequently, thus reducing the effects of flexure of the diaphragm on conductor fatigue. Thus, by providing a continuous single circuit trace 12, as shown in FIG. 3, it is possible to extend the life of the continuous circuit trace to at least that of the metal diaphragm 12.

Figure 4:
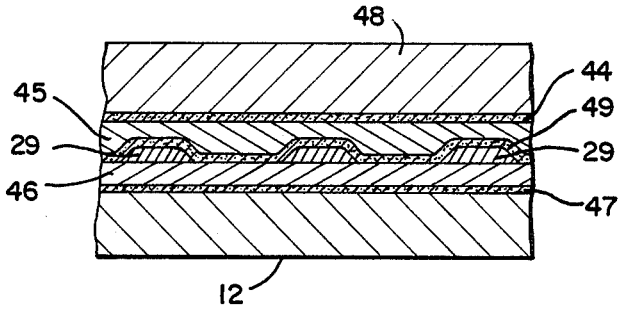
FIG. 4 is a cross-sectional view of the diaphragm with a respective sensing circuit trace.

A section view of the metal diaphragm 12, taken from FIG. 2, which is applicable to the construction of FIG. 3, is shown in FIG. 4. FIG. 4 illustrates the metal diaphragm 12 bonded along line 47 to a substrate 46. The insulating substrate 46 is a printed circuit material which may be the well-known DuPont polyimide film, referred to in the trade as KAPTON, having bonded thereto metal foil. The metal foil is photochemically etched to derive the required conductor circuit trace 29.

The conductor circuit trace 29 is further encapsulated with bonded layers 45, 48, which may also be polyimide film to provide insulation between the conductor circuit trace 29 and the hydraulic liquid which would necessarily contact that side of the diaphragm bearing the conductor trace 29. The layers 45 and 48 are approximately 2 mils and 5 mils thick, bonded along line 44 with a B-staged modified acrylic adhesive, as well as being bonded to the circuit trace 29 along line 49, which has a thickness of 3 mils on a 2 mil substrate 46. Diaphragm 12 and substrate 46 are similarly bonded together along line 47 with the same adhesive.

The continuous circuit trace of the embodiments of FIGS. 2 and 3 provide for two separate modes of failure detection.

Figure 5:
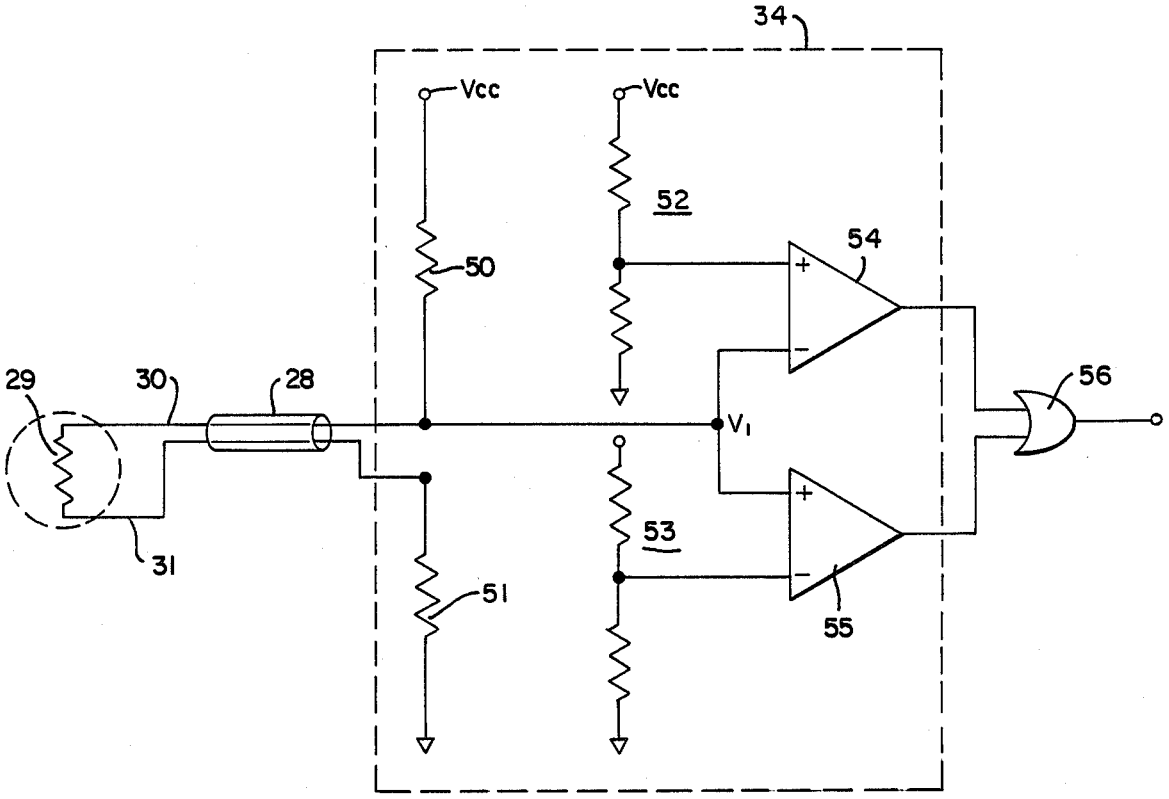
FIG. 5 shows circuitry for detecting a failure condition.

Turning now to FIG. 5, there is shown a circuit 34 which will provide failure sensing in two distinct modes. The continuous circuit trace 29 is shown as a resistive element in FIG. 5. Each of the conductor leads 30, 31, connected to leads 28, is terminated in first and second resistances 50 and 51, respectively. Resistances 50 and 51 are in turn connected across a DC voltage supply represented by VCC and a standard ground symbol. The DC voltage will provide a small but measurable current flowing through resistor 50, continuous circuit trace 29 and resistor 51.

The circuit of FIG. 5 will detect two types of failures. The first is a break in continuity of the single conductor circuit trace 29. To detect the break in the circuit trace, a first high limit comparator 54 is provided. Comparator 54 has a reference threshold voltage set by resistor network 52. If the circuit trace 29 should be broken due to an imminent diaphragm failure, the potential in the voltage comparator 54 inverting input would rise significantly, triggering an OPEN signal.

Alternatively, an imminent diaphragm failure may be sensed by a ground current formed when conductor 29 comes in contact with either the pumping liquid or the pump head 15, or other component of the diaphragm pump due to an insulation failure. This ground fault current would result in a lowering of the potential V1 such that the voltage comparator 55 would sense the ground fault condition. The reference voltage provided to comparator 55 is supplied by a resistor network 53, set to a level indicating the presence of a ground fault with the circuit trace 29.

The detection of a break in the circuit trace can sometimes be masked by the presence of a conductive pumping liquid such as strongly acidic or basic substances. The ground fault detection mode will, of course, sense the presence of such liquid, permitting rapid alternative failure mode detection. This method of failure detection is especially useful to detect incipient failure, prior to full rupture across the thickness of the diaphragm.

Each of the conditions representing failure of a diaphragm are supplied to an OR gate 56 which will provide a logic signal for operating an audible or visual alarm.

Although not shown in FIG. 5, it is possible to monitor each input of OR gate 56. Different fault conditions represented by each input of OR gate 56 can be utilized to indicate the type of corrective action to be taken.

It is clear that the foregoing technique for detecting failure of a diaphragm in the presence of an electrically conductive liquid provides increased reliability by using multiple detection modes. Furthermore, in the case of an imminent failure causing circuit exposure to a conductive liquid prior to circuit breakage, it provides reduced response time. Additionally, by employing the advantageous configurations of FIG. 3 and its obvious variants, the diaphragm circuit trace 29 is not subject to excessive strain, such that the sensing circuit trace 29 suffers a failure earlier in time than the diaphragm itself.

Two prominent features of this invention, both of which afford it significant advantages over conventional devices, are that it is independent of the characteristics of the liquids adjacent to either side of the diaphragm (particularly viscosity and electrical conductivity) and that the spacing between adjacent conductors establishes the resolution of detection, that is, it establishes the largest rupture than can occur without detection.

The foregoing description of a metal diaphragm pump is, of course, equally applicable to non-metallic diaphragms. The plastic diaphragms made of PTEE (polytetrafluoroethylene), and other well known diaphragm materials shown in FIG. 6 may include an imbedded continuous circuit trace 29 such as is shown in FIGS. 2 and 3. The conductor may be a stainless steel conductor 29 of 3 mils thickness which is corrosion-resistant and having high flexural fatigue strength. A substrate 58 of 3–5 mils thickness supports the steel conductor trace etched to the required configuration. The conductor material may be bonded to the substrate by any of several known industrial processes. The substrate may be a thermoplastic fluorocarbon, such as fluorinated ethylene propylene generically referred to as FEP or perfluoroalkyoxytetrafluoroethylene, generally referred to as PFA.

Figure 6:
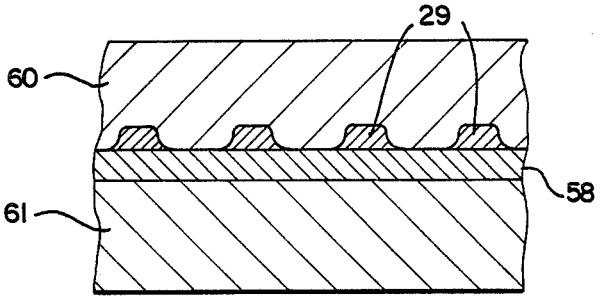
FIG. 6 is a cross-sectional view of a plastic or elastomer diaphragm having a sensing circuit trace.

The etched conductor and supporting substrate is bonded between two layers of diaphragm material 60, 61 such as PTFE polytetrafluoroethylene which are bonded together, as shown in FIG. 6, by a combination of heat and pressure, forming a laminated structure. PTFE is not a thermoplastic material, but it will form effective surface bonds to FEP and PFA at temperatures below the point at which its sintered structure is destroyed.

Still other common industrial processes may be utilized to implement the conductor circuit trace in a non-metallic diaphragm. For instance, an unsupported circuit can be photochemically etched by a process called chemical milling. The resulting circuit trace may be positioned and encapsulated between layers of PTFE bonded to one another by means of thermoplastic PFA or FEP layers, applied in the form of film or powder below and/or above the circuit traces. Heat and pressure are applied sufficient to bond the structure together.

Alternatively, a circuit trace may be fused with heat and pressure between layers of like thermoplastic materials, such as the foregoing, to provide a simple, homogeneous matrix encapsulating the entire circuit trace.

As used throughout this specification, the word disphragm is not restricted to disks or initially flat surfaces, but is construed to mean any shape suitable to perform the functions of a diaphragm.

Figure 7:
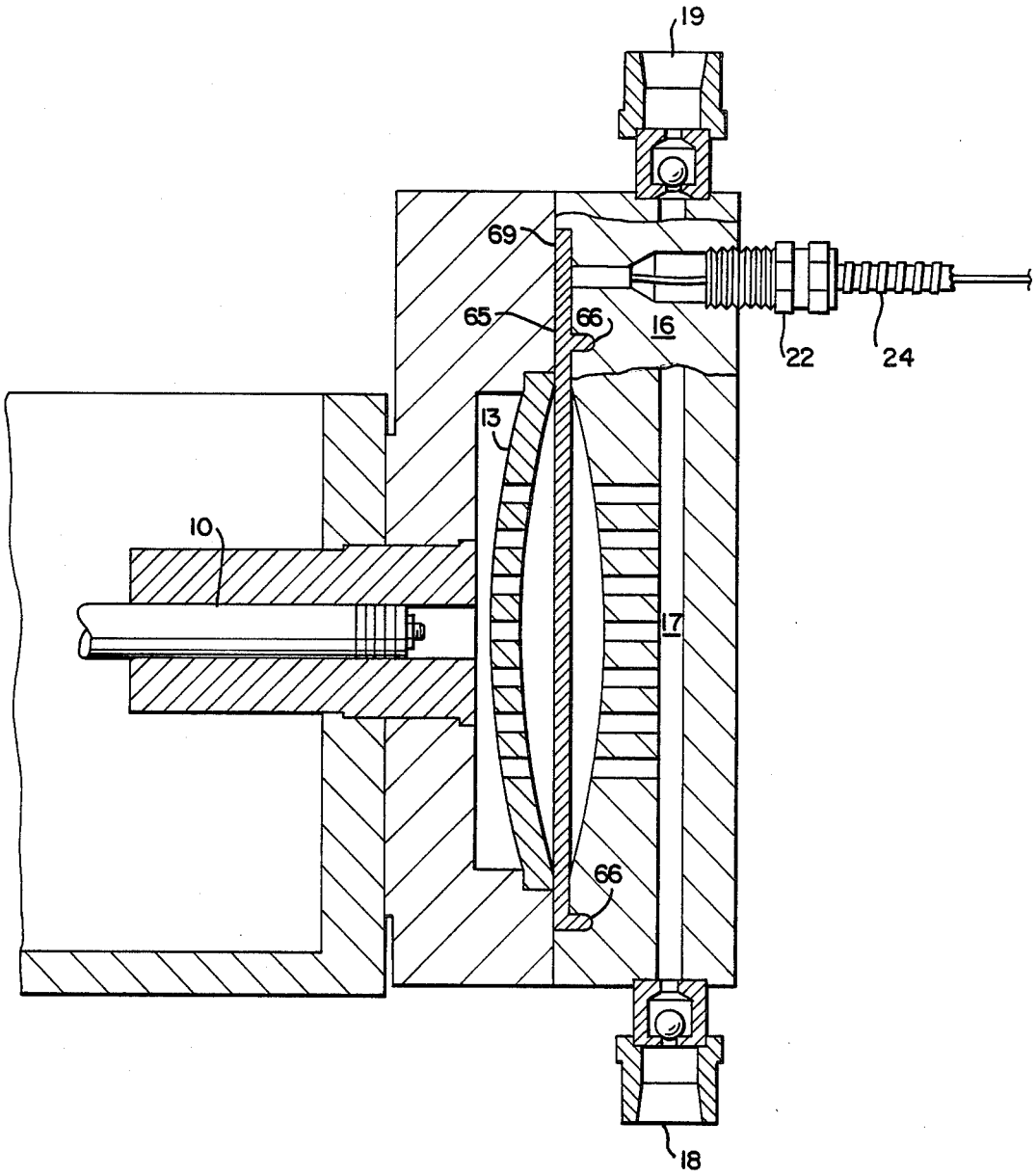
FIG. 7 illustrates a diaphragm pump incorporating a non-metallic diaphragm in accordance with the invention.

A practical embodiment of the plastic diaphragm incorporating the present invention is shown in FIG. 7. FIG. 7 illustrates the common diaphragm pump as illustrated in FIG. 1, modified to receive a plastic diaphragm 65.

Diaphragm 65 has an internal construction as demonstrated in FIG. 6. Additionally, a flange 66 is incorporated on the diaphragm which is received in a like facing channel of the reagent head 16. The flange 66 is advantageous to prevent the diaphragm 65 from slipping between the reagent head 16 and the dish plate 13, as well as provide a seal for reagent head 16 analogous to an O-ring seal against leakage of the pumped fluid.

Additionally, a tab 69 extends from the periphery of the diaphragm 65, supporting the ends of the spiral circuit trace.

A bulkhead connector 22 is shown threaded into a portion of the reagent head 16 at a location clear of the pumping chamber. The threaded bulkhead connector 22 supports the armor 24 and conveys conductors 28 to the tab 69 for connection to the circuit trace winding.

Figure 8:
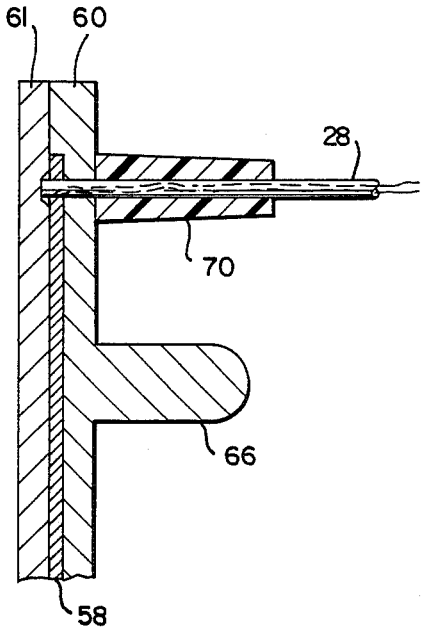
FIG. 8 illustrates a view of the non-metallic diaphragm used in the pump of FIG. 7.

A detail of the plastic diaphragm is shown in FIG. 8 illustrating the flange 66 which is integral to the diaphragm layer 60. A substrate 58 bearing the required circuit trace is encapsulated between diaphragm material 60 and 61, in accordance with the foregoing methods. A plastic sleeve 70 containing conductors 28 is fused to layer 60 and the bare conductor ends of conductors 28 are soldered into two eyelets in the substrate 58 bearing each end of the circuit trace. The plastic insulation 70 provides a hermetic seal with the diaphragm material 60. The sleeve 70 and connections of conductors 28 to eyelets 37 and 38 are effected before layer 61 is bonded or fused in place.

Figure 9:
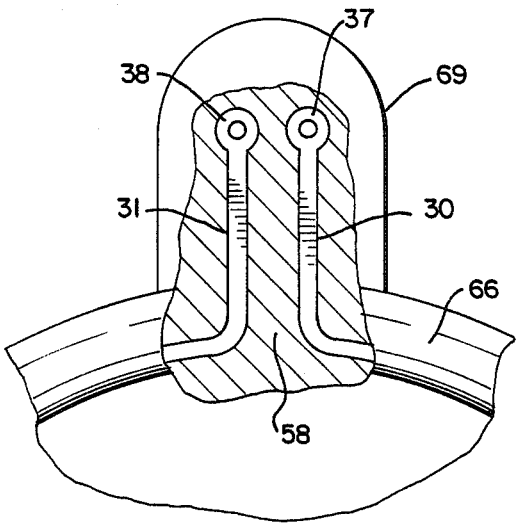
FIG. 9 illustrates the detail for connecting the circuit trace to conductors 28.

As shown in FIG. 9, the substrate 58 has an extension bearing the ends 30 and 31 of the conductor trace. Two eyelets 37 and 38 can receive the conductors 28.

Thus, it is seen that the foregoing invention may be implemented in a plastic diaphragm as well as in the metal diaphragm of the embodiments of FIGS. 1–5. The teaching of the modified spiral trace of FIG. 3 is, of course, applicable to the plastic diaphragm as well as the metal diaphragm.

Thus, having described our invention in terms of the preferred embodiments, those skilled in the art will recognize yet other embodiments defined more particularly by the claims which follow.

What is claimed is:

1. An apparatus for determining a pump diaphragm failure comprising:

a single continuous circuit trace supported by said diaphragm, and insulated therefrom, and from a pumping medium, traversing substantially the entire surface area of said diaphragm;

an electrical circuit means connected to said continuous circuit trace for measuring both circuit trace continuity and a ground fault condition between said circuit trace and a pumping environment, whereby a diaphragm failure is detected when either said circuit trace electrical continuity is broken or said pumping environment comes into contact with said continuous circuit trace; and, an alarm connected to said electrical circuit for indicating said diaphragm failure.

2. The apparatus of claim 1 wherein said continuous circuit trace is disposed in a plurality of radial spokes on said diaphragm, beginning at the periphery of said diaphragm extending to the center thereof, each spoke connected to an adjacent radial spoke to form a single continuous circuit trace.

3. The apparatus of claim 2 wherein said radial spokes comprise a plurality of circumferential segments which decrease in size towards said diaphragm center providing a plurality of direction changes increasing the mechanical resistance to failure.

4. The apparatus of claim 2 wherein the single continuous circuit trace is a conductive trace formed on a printed circuit substrate, said substrate being bonded to said diaphragm, said conductive trace including an insulative film over said trace.

5. The apparatus of claim 1 wherein said continuous circuit trace changes direction a plurality of times while traversing said diaphragm surface, reducing strain on said circuit trace during flexure of said diaphragm.

6. The apparatus of claim 1 wherein said diaphragm comprises a continuous metallic circuit trace disposed on a substrate between first and second diaphragm halves forming a laminated structure.

7. The apparatus of claim 1 wherein said diaphragm is of stainless steel, and said single continuous trace is supported on a substrate bonded to said stainless steel diaphragm.

8. The apparatus of claim 7 further comprising a coating over said continuous circuit trace insulating said trace from said pumping medium.

9. The apparatus of claim 1 wherein said circuit trace is disposed on a substrate between two plastic diaphragm halves insulating said circuit trace from a fluid on one side of said diaphragm.

10. The apparatus of claim 9 wherein one of said diaphragm halves includes an integral annular flange.

11. An apparatus for determining a pump diaphragm failure comprising:

a single continuous circuit trace disposed on said diaphragm, insulated from a pumping environment, said continuous circuit trace traversing substantially all the surface area of said diaphragm;

a voltage supply connected through a first resistance element to one end of said circuit trace, and connected through a second resistance element to a second end of said circuit trace, whereby a current flow through said circuit trace is established;

a window comparator circuit connected to compare the voltage potential on one of said circuit trace ends with first an second threshold levels, whereby a fault is detected when said circuit trace either experiences an open circuit or when said pumping environment comes in contact with said circuit trace; and, failure indicating means connected to said comparator circuit for indicating said detected fault.

12. The apparatus of claim 11 wherein said continuous circuit trace is in the form of a double spiral beginning at the center of said diaphragm.

13. A method for detecting a failure of a diaphragm separating two liquid mediums, comprising:

disposing a continuous circuit trace over a major portion of said diaphragm;

measuring the continuity of said circuit trace;

measuring a current flowing between said circuit trace and one of said liquid mediums; and indicating a failure when either said continuity of said circuit trace changes or said current flowing between said circuit trace and said liquid medium changes.

14. The method of claim 13 further comprising:

disposing said circuit trace between two halves of said diaphragm to insulate; and fusing said two halves and circuit trace together to form a single diaphragm structure.

15. The method of claim 13 wherein said circuit trace is etched on a substrate fixed to said diaphragm.

* * * * *